US009658036B2

(12) United States Patent
Zobell

(10) Patent No.: US 9,658,036 B2
(45) **Date of Patent: *May 23, 2017**

(54) ADAPTOR ASSEMBLIES FOR ARROW ASSEMBLIES AND ARROW ASSEMBLIES INCLUDING ADAPTOR ASSEMBLIES

(71) Applicant: GOLD TIP, LLC, Orem, UT (US)

(72) Inventor: Brock D. Zobell, Springville, UT (US)

(73) Assignee: Gold Tip, LLC, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/093,144

(22) Filed: Apr. 7, 2016

(65) Prior Publication Data

US 2016/0238356 A1 Aug. 18, 2016

Related U.S. Application Data

(63) Continuation of application No. 14/600,998, filed on Jan. 20, 2015, now Pat. No. 9,366,510.

(51) Int. Cl.
*F42B 6/08* (2006.01)
*F42B 6/04* (2006.01)

(52) U.S. Cl.
CPC . *F42B 6/04* (2013.01); *F42B 6/08* (2013.01)

(58) Field of Classification Search
CPC ..... F42B 6/08
See application file for complete search history.

(56) References Cited

U.S. PATENT DOCUMENTS 3,401,938 A * 9/1968 Bear ..... F42B 6/08 473/582
3,868,114 A * 2/1975 Groner ..... F42B 6/08 473/582
4,874,180 A * 10/1989 Fingerson ..... F42B 6/04 473/578
4,943,067 A * 7/1990 Saunders ..... F42B 6/04 403/13
5,496,043 A * 3/1996 Ester ..... F42B 6/08 473/584
5,902,199 A * 5/1999 Adams, Jr. ..... F42B 6/04 473/578
5,921,875 A * 7/1999 Bickel ..... F42B 6/04 403/299
6,554,725 B1 * 4/2003 Schaar ..... F42B 6/04 473/578
6,932,728 B2 * 8/2005 Palomaki ..... F42B 6/08 473/578
7,004,859 B2 * 2/2006 Palomaki ..... F42B 6/08 473/578
7,077,770 B2 * 7/2006 Palomaki ..... F42B 6/08 473/578
7,115,055 B2 * 10/2006 Palomaki ..... F42B 6/08 473/578
7,270,618 B2 * 9/2007 Palomaki ..... F42B 6/08 473/578

(Continued)

*Primary Examiner* — John Ricci
(74) *Attorney, Agent, or Firm* — Hovey Williams LLP

(57) ABSTRACT

Adapter assemblies for arrow assemblies include an insert configured to be received within an arrow shaft and configured to be coupled to a point. The adapter assembly further includes an outer sleeve disposed around at least a portion of the insert. Arrow assemblies include an arrow shaft and an adapter assembly including an insert and an outer sleeve for coupling a point to the arrow shaft.

16 Claims, 4 Drawing Sheets

(56) References Cited

U.S. PATENT DOCUMENTS

| | | | | |
|---|---|---|---|---|
| 7,374,504 | B2 * | 5/2008 | Palomaki | F42B 6/08 473/578 |
| 7,608,001 | B2 * | 10/2009 | Palomaki | F42B 6/08 473/578 |
| 7,651,421 | B2 * | 1/2010 | Smith | F42B 6/04 473/582 |
| 8,016,703 | B1 * | 9/2011 | Kronengold | F42B 6/08 473/582 |
| 8,262,518 | B2 * | 9/2012 | Palomaki | F42B 6/08 473/582 |
| 8,337,341 | B1 * | 12/2012 | Huang | F42B 6/08 473/582 |
| 8,337,342 | B1 * | 12/2012 | Huang | F42B 6/04 473/582 |
| 8,460,134 | B2 * | 6/2013 | Palomaki | F42B 6/08 473/582 |
| 9,366,510 | B1 * | 6/2016 | Zobell | F42B 6/04 |
| 2009/0163308 | A1 * | 6/2009 | Odabachian | F42B 6/08 473/582 |
| 2012/0149506 | A1 * | 6/2012 | Connolly | F42B 6/04 473/578 |
| 2013/0288831 | A1 * | 10/2013 | James | F42B 6/08 473/578 |
| 2014/0329625 | A1 * | 11/2014 | James | F42B 6/08 473/578 |

* cited by examiner

ADAPTOR ASSEMBLIES FOR ARROW ASSEMBLIES AND ARROW ASSEMBLIES INCLUDING ADAPTOR ASSEMBLIES

RELATED APPLICATIONS

The present application is a continuation application and claims priority of co-pending application titled "ADAPTOR ASSEMBLIES FOR ARROW ASSEMBLIES AND ARROW ASSEMBLIES INCLUDING ADAPTOR ASSEMBLIES", Ser. No. 14/600,998, filed Jan. 20, 2015.

TECHNICAL FIELD

Embodiments of the present disclosure relate to adapter assemblies for coupling at least one component of an arrow to an arrow shaft. More particularly, embodiments of the present disclosure relate to adapter assemblies for coupling an arrowhead or arrow point to an arrow shaft and related methods.

BACKGROUND

Many different types of arrows and arrow shafts are used in hunting and sport archery. Arrows conventionally include a hollow arrow shaft (e.g., made from lighter materials such as composite carbon fiber) that are attached to a number of standard components. Such components may include adapters or inserts for attaching points (e.g., field points, broadheads, etc.) at the leading or distal end of the arrow or arrow shaft, and nocks at the trailing or proximal end of the arrow or arrow shaft. Vanes or other fletching are also conventionally secured to the trailing end of the arrow shaft to facilitate proper arrow flight.

In conventional arrow systems, a point may be removably attached to the arrow shaft using one or more insert components. For example, an insert having a threaded end portion may be affixed within a hollow arrow shaft by inserting at least a portion of the insert into the hollow arrow shaft. A point having a complementary threaded portion may then be threaded into or onto the threaded portion of the insert. Removably attaching the point to the arrow shaft in this manner enables archers to mix and match various points and arrow shafts as may be required for differing hunting or sport archery applications.

The precise axial alignment of the arrow point with the arrow shaft generally depends on the insert and how the insert interfaces with the arrow shaft. Even minor misalignment of the insert and/or point relative to the arrow shaft has the potential to adversely affect the radial alignment (e.g., concentricity) of the arrow point with the arrow shaft. Furthermore, the arrow shaft is subjected to substantially axial impact forces when the arrow point hits a target or other object. These impact forces can potentially damage one or more of the shaft, insert, and point depending on the configuration of these components, necessitating repair or replacement of one or more of these components including the arrow shaft.

Such problems with concentricity and the forces experienced upon impact may be particularly prevalent in arrow assemblies having reduced or small diameter shafts, which reduced or small diameter shafts are discussed in detail below. While standard arrow assemblies may be able to utilize inserts that have a majority or an entirety of the insert in the arrow shaft to receive the majority or entirety of the shank of the point, reduced or small diameter arrow assemblies have a reduced inner diameter that may be unable to accommodate the shank of the point (e.g., a standard point that complies with guidelines set by the Archery Trade Association (ATA)), unless the point has been specifically designed outside of the guidelines of the ATA to fit within an arrow shaft having a reduced inner diameter. Accordingly, at least a portion of the insert and shank of the point must be positioned outside or external to the arrow shaft or an outsert (i.e., an adaptor coupled to the outer diameter of the arrow shaft) must be utilized. However, such configurations may decrease one or more of the strength, stability, and accuracy of the overall arrow assembly as inserts that extend longitudinally outward of the distal end of the arrow shaft and outserts secured to the external surface of the shaft and extend longitudinally outward therefrom are subject to high forces when the arrow assembly contacts a target or other object and may tend to fail, for example, at the interface between the portion of the insert or outsert attached to the arrow shaft. In particular, in conventional inserts and outserts, the portion of the insert or outsert attached to the arrow shaft contacts only one of an inner diameter surface or outer diameter surface of the arrow shaft. Thus, impact forces on the arrow assembly may cause the coupling between the insert or outsert to fail or may cause failure in the arrow shaft itself when the arrow assembly contacts a target or other object.

Furthermore, outserts, which are attached to the outer diameter of the arrow shaft, tend to deviate from the concentricity of the arrow shaft as the outer diameter of the arrow shaft (e.g., a composite arrow shaft) may not have as close dimensional tolerances as the inner diameter of the arrow shaft, which is typically formed around a mandrel.

BRIEF SUMMARY

In some embodiments, the present disclosure comprises an adapter assembly for an arrow assembly. The adapter assembly includes an insert comprising a first shaft coupling portion configured to be received within an arrow shaft and a second point coupling portion configured to be coupled to a point. The adapter assembly further includes an outer sleeve disposed around at least a portion of the insert. The outer sleeve is configured to receive at least the second point coupling portion of the insert where the outer sleeve is further configured to extend around at least a portion of an outer circumferential surface of the arrow shaft.

In further embodiments, the present disclosure comprises an adapter assembly for an arrow assembly. The adapter assembly includes an insert having a first end portion configured to be at least partially received within an arrow shaft of an arrow assembly and a second end portion configured to be coupled to a point of the arrow assembly. The adapter assembly further includes an outer sleeve receiving at least a portion of the second end portion of the insert within a hollow bore in the outer sleeve. The outer sleeve is configured to extend along and surround at least one quarter of a length of a portion of the insert.

In yet further embodiments, the present disclosure comprises an arrow assembly. The arrow assembly includes an arrow shaft and an adapter assembly for coupling a point to the arrow shaft. The adapter assembly includes an insert comprising a first shaft coupling portion received within the arrow shaft and a second point coupling portion configured to be coupled to the point. The adapter assembly further includes an outer sleeve disposed around at least a portion of the insert and a portion of the arrow shaft.

DETAILED DESCRIPTION

The illustrations presented herein are not actual views of any particular arrow assembly or component thereof, but are merely idealized, schematic representations that are employed to describe embodiments of the present disclosure. Additionally, elements common between figures may retain the same or similar numerical designation.

As used herein, the terms "distal" and "proximal" of an arrow assembly or component thereof refer to relative distances between portions of the arrow assembly and the string of a bow assembly that is placed in contact with the arrow assembly during normal use (i.e., during aiming and firing of an arrow from an archery bow). For example, a distal end refers to an end of an arrow assembly farther away from the string of a bow assembly when the arrow assembly is being prepared to be launched from the bow assembly and a proximal end refers to an end closer to or in contact with the string of the bow assembly.

Figure 1:
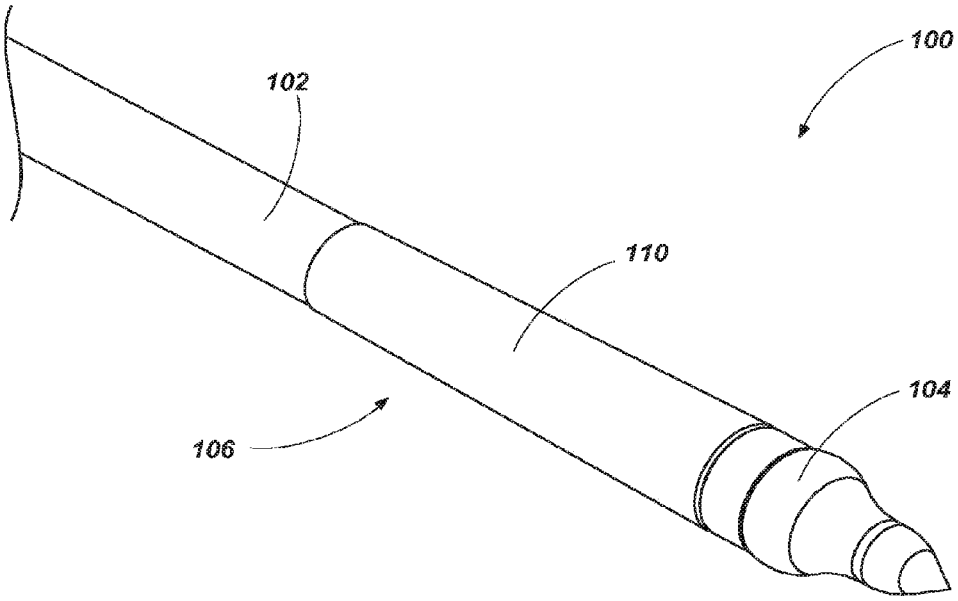
FIG. 1 is a perspective view of a portion of an arrow assembly including an adapter assembly in accordance with an embodiment of the present disclosure.

FIG. 1 is a perspective view of a portion of an arrow assembly including an adapter assembly. As shown in FIG. 1, arrow assembly 100 includes an arrow shaft 102 coupled to a point 104 with an adapter assembly 106 comprising outer sleeve 110.

In some embodiments, the arrow shaft 102 may comprise a reduced or small diameter arrow shaft having one or more of a cross-sectional inner diameter of, for example, less than 0.24 inch (6.096 mm) (e.g., about 0.204 inch (5.1816 mm) or less, about 0.166 inch (4.2164 mm) or less) and a cross-sectional outer diameter of, for example, less than 0.275 inch (6.985 mm) (e.g., about 0.262 inch (6.6548 mm) or less, about 0.242 inch (6.1468 mm) or less).

In some embodiments, the arrow shaft 102 may comprise a material such as a composite material (e.g., fibers, such as, carbon fibers, in a matrix, such as a polymer matrix). In other embodiments, the arrow shaft 102 may comprise other materials such as, for example, a metal or metal alloy (e.g., aluminum), organic materials (e.g., wood, bamboo, etc.), or combinations of the aforementioned materials.

In some embodiments, the point 104 may comprise any suitable tip, arrowhead, broadhead, field point, target point, etc. In some embodiments, the point 104 may comprise a point that complies with guidelines set by the Archery Trade Association (ATA).

Figure 2:
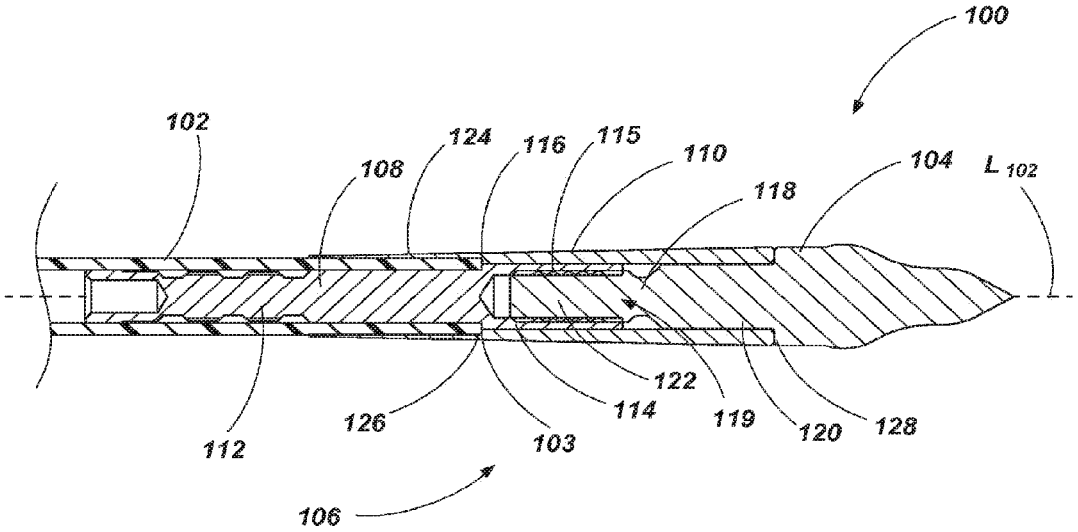
FIG. 2 is a longitudinal cross-sectional view of the portion of the arrow assembly including the adapter assembly of FIG. 1.

FIG. 2 is a longitudinal cross-sectional view of the portion of the arrow assembly 100 including the adapter assembly 106 of FIG. 1. As shown in FIG. 2, the adapter assembly 106 may include more than one component. The adapter assembly 106 may include an insert 108 and an outer sleeve 110 disposed about at least a portion of the insert 108. For example, at least a portion of the outer sleeve 110 may be disposed around and extend along at least a portion of the insert 108 in a direction along a longitudinal axis L102 of the arrow shaft 102. For example, the insert 108 and the outer sleeve 110 may be mutually arranged such that both the insert 108 and the outer sleeve 110 would be intersected by a plane extending in a direction transverse to the longitudinal axis L102 of the arrow shaft 102. The outer sleeve 110 may be separate from the insert 108, for example, where each of the insert 108 and the outer sleeve 110 comprise individual components rather than one unitary body.

In some embodiments, one or more portions of the adapter assembly 106 may comprise materials such as a metal, a metal alloy, a composite, a polymer, a ceramic, or combinations thereof. For example, the insert 108 and the outer sleeve 110 may each comprise a metal alloy, such as, for example, high-strength aluminum.

As depicted, the insert 108 of the adapter assembly 106 may be received (e.g., partially received) in the hollow interior of the arrow shaft 102. For example, a shaft coupling portion 112 of the insert 108 may be received within the hollow interior of the arrow shaft 102 and may be coupled to the arrow shaft 102 (e.g., with an adhesive, with a mechanical interference coupling or fit, etc.). In other words, the insert 108 and the arrow shaft 102 are mutually arranged such that both the insert 108 and the arrow shaft 102 would be intersected by a plane extending in a direction transverse to the longitudinal axis L102 of the arrow shaft 102.

The insert 108 may also include a point coupling portion 114 (e.g., on a side opposing the shaft coupling portion 112) that couples with the point 104. For example, the point coupling portion 114 of the insert 108 may couple with the point 104 via threaded connection 115, which includes threads in the point coupling portion 114 and complementary threads on the point 104. In some embodiments, and as depicted in FIG. 2, the point coupling portion 114 may at least partially extend from a distal end 103 of the arrow shaft 102. For example, a portion of the point coupling portion 114 (e.g., an entirety of the point coupling portion 114) may extend from the distal end 103 of the arrow shaft 102 and be outside or external to the arrow shaft 102 (e.g., not within the hollow bore of the arrow shaft 102). In such an embodiment, the positioning of the point coupling portion 114 of the insert 108 outside of the arrow shaft 102 may also position at least a portion of the point 104 (e.g., an entirety of the point 104) outside or external to the arrow shaft 102 (e.g., not within the hollow bore of the arrow shaft 102).

In some embodiments, the insert 108 may include a lip, which may also be characterized as a flange, 116 that engages with the distal end 103 of the arrow shaft 102 to position the point coupling portion 114 of the insert 108 relative to the arrow shaft 102. For example, the flange 116 may engage with the distal end 103 of the arrow shaft 102 to position the point coupling portion 114 external to the hollow bore of the arrow shaft 102 and to further position the shaft coupling portion 112 within the arrow shaft 102.

As discussed above, in some embodiments, the point 104 may comprise a point that complies with the guidelines set by the Archery Trade Association (ATA). For example, the point 104 may include a shank 118 for coupling with a portion of the adapter assembly 106 (e.g., a threaded aperture 119 of the point coupling portion 114 of the insert 108). The shank 118 of the point 104 includes a first non-threaded extension portion 120 (e.g., with an outer diameter of approximately 0.2025 inch (5.1435 mm)) and a second threaded portion 122 (e.g., having a #8-32 thread, which has an outer diameter of approximately 0.1640 inch (4.1656 mm)).

As further shown in FIG. 2, the outer sleeve 110 may be disposed over and extend around at least a portion of the insert 108 and a portion of the arrow shaft 102. In other words, at least a portion of the insert 108 and a portion of the arrow shaft 102 may be received within a hollow bore of the outer sleeve 110. The outer sleeve 110 may be disposed over and extend around at least the point coupling portion 114 of the insert 108. For example, the outer sleeve 110 may extend along (e.g., in the direction along the longitudinal axis L102 of the arrow shaft 102) and around (e.g., about the longitudinal axis L102 of the arrow shaft 102) an entirety of the point coupling portion 114 of the insert 108. In some embodiments, a first portion (e.g., a middle portion) of the outer sleeve 110 may extend around and abut the point coupling portion 114 of the insert 108 (e.g., to be centered around the point coupling portion 114 of the insert 108) and a second portion may receive (e.g., extend around and/or abut) the non-threaded portion 120 of the point 104. In such an embodiment, the insert 108 may be aligned off of (e.g., relative to) an inner diameter of the arrow shaft 102 to radially align the insert 108 with the arrow shaft 102 (e.g., such that the insert 108 is concentric with the arrow shaft 102). Further, one or more of the outer sleeve 110 and the point 104 may be aligned off of the insert 108 to radially align the outer sleeve 110 and/or the point 104 with the arrow shaft 102 via the insert 108 (e.g., such that the outer sleeve 110 and/or the point 104 is concentric with the arrow shaft 102).

The outer sleeve 110 may extend along the insert 108 a select distance in the direction along the longitudinal axis L102 of the arrow shaft 102. For example, the outer sleeve 110 may extend along at least one quarter of the length (e.g., at least one third of the length of the insert 108, at least one half of the length of the insert 108) of the insert 108 in the direction along the longitudinal axis L102 of the arrow shaft 102.

A third portion (e.g., a proximal portion) of the outer sleeve 110 may be disposed over and extend around a portion of the arrow shaft 102. For example, the outer sleeve 110 may include a stepped portion 124 on an inner circumference of the outer sleeve 110. The stepped portion 124 may have an inner diameter at the proximal portion of the outer sleeve 110 that is greater than an inner diameter at an adjacent portion (e.g., the middle portion and/or the distal portion) of the outer sleeve 110. The differing inner diameters may act to form a step or internal flange 126 within the outer sleeve 110 that may abut with the distal end 103 of the arrow shaft 102. In some embodiments, the internal flange 126 of the outer sleeve 110 may be positioned proximate (e.g., at the same axial location along the longitudinal axis L102 of the arrow shaft 102, radially coextensive with) the outer flange 116 of the insert 108. For example, the flange 116 of the insert 108 may abut with an inner portion of the distal end 103 of the arrow shaft 102 while the adjacent, internal flange 126 of the outer sleeve 110 abuts with an outer portion of the distal end 103 of the arrow shaft 102. In other embodiments, the inner flange 126 of the outer sleeve 110 may engage with an outer portion of the insert 108 (e.g., an enlarged diameter or another outer flange) rather than the arrow shaft 102.

The enlarged diameter of the stepped portion 124 of the outer sleeve 110 may be sized to be disposed over (e.g., fit and extend around) an outer, circumferential surface of the arrow shaft 102. In some embodiments, the stepped portion 124 of the outer sleeve 110 may be sized to be in at least partial contact with the outer surface of the arrow shaft 102.

The stepped portion 124 of the outer sleeve 110 may extend along a portion of the arrow shaft 102 that has a portion of the insert 108 received in the arrow shaft 102. For example, a portion of the outer sleeve 110 may extend along both a portion of the arrow shaft 102 and at least a portion of the insert 108 that is received within that portion of the arrow shaft 102 in the direction along the longitudinal axis L102 of the arrow shaft 102. In some embodiments, the stepped portion 124 of the outer sleeve 110 may extend a length of approximately 0.25 inch to 1.00 inch (6.35 mm to 25.4 mm) (e.g., 0.5 inch (12.7 mm), 0.45 inch (11.43 mm)) along the arrow shaft 102 in the direction along the longitudinal axis L102 of the arrow shaft 102.

In some embodiments, the coupling of the insert 108 within the arrow shaft 102 (e.g., via an adhesive) and the coupling of the point 104 to the point coupling portion 114 of the insert 108 may act to secure the outer sleeve 110 to the arrow shaft 102. For example, as the point 104 is threaded into point coupling portion 114 of the insert 108, a flange 128 on the point 104 may force the inner flange 126 of the outer sleeve 110 into contact with the distal end 103 of the arrow shaft 102. Compression of the outer sleeve 110 between the point 104 and the arrow shaft 102 may act to secure the outer sleeve 110 on the arrow shaft 102 and the arrow assembly 100.

Figure 3:
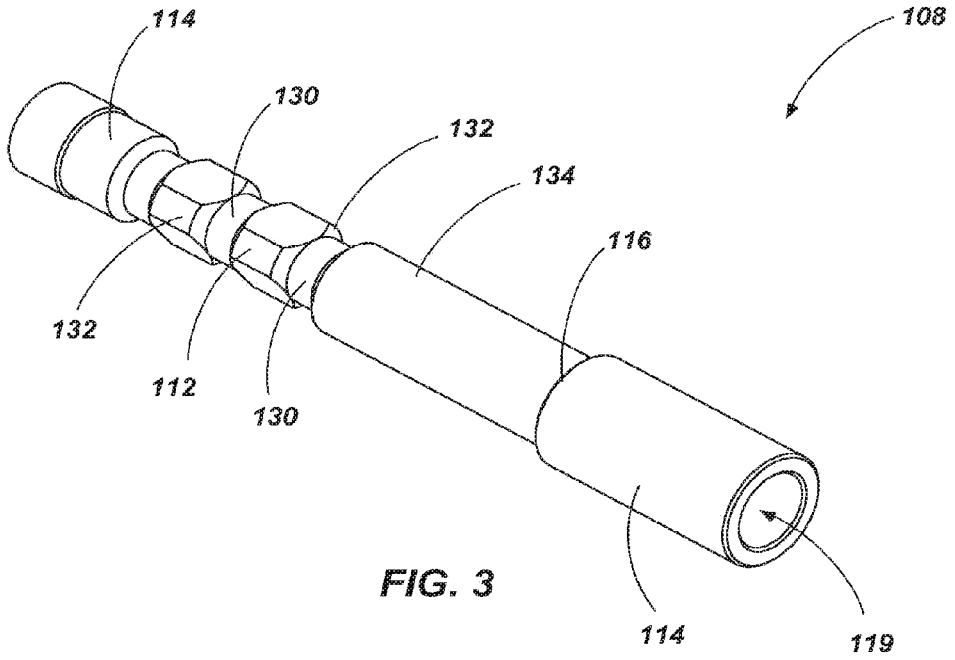
FIG. 3 is a perspective view of a portion of an adapter assembly that may be utilized with an arrow assembly (e.g., the arrow assembly shown in FIGS. 1 and 2) in accordance with an embodiment of the present disclosure.
Figure 4:
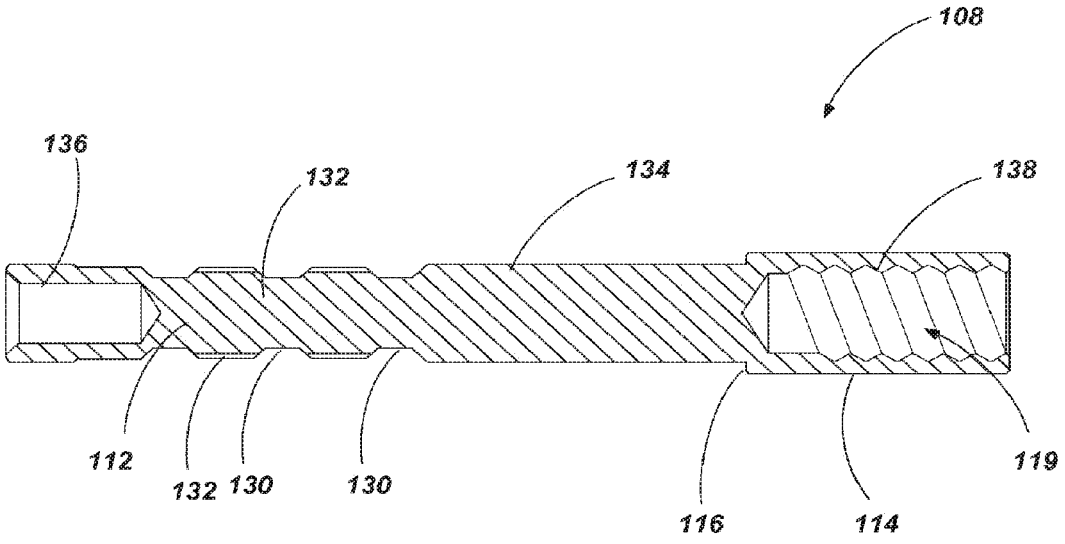
FIG. 4 is a longitudinal cross-sectional view of the portion of the adapter assembly of FIG. 3.

FIG. 3 is a perspective view of a portion (e.g., the insert 108) of an adapter assembly (e.g., the adapter assembly 106 shown and described with reference to FIGS. 1 and 2) that may be utilized with an arrow assembly (e.g., the arrow assembly 100 shown in FIGS. 1 and 2) and FIG. 4 is a longitudinal cross-sectional view of the insert 108 of FIG. 3. As shown in FIGS. 3 and 4, the insert 108 includes the shaft coupling portion 112 of the insert 108 that is received within and coupled to the arrow shaft 102 (FIGS. 1 and 2). The shaft coupling portion 112 of the insert 108 may include one or more reduced diameter sections 130 (e.g., spaced along the length of the insert 108). One or more protrusions 132 may be formed in the reduced diameter sections 130 of the insert 108. In some embodiments, the protrusions 132 may have a radial extent similar to that of the radial extent an adjacent, middle portion 134 of the insert 108 where one or more of the middle portion 134 of the insert 108 and the protrusions 132 extending from the shaft coupling portion 112 of the insert 108 are sized to extend to and engage with an inner surface of the arrow shaft 102. Such a configuration may allow for spacing between the outer diameter of the insert 108 at the reduced diameter sections 130 and the inner diameter of the arrow shaft 102 to enable a volume for adhesive to be positioned between the insert 108 and the arrow shaft 102 within the arrow shaft 102 while one or more portions of the insert 108 (e.g., the protrusions 132 and/or middle portion 134) engage with inner surfaces of the arrow shaft 102. The volume of adhesive in the voids formed between the reduced diameter sections 130 and the inner diameter of the arrow shaft 102 acts to secure the insert 108 within the arrow shaft 102.

In some embodiments, the insert 108 may include the flange 116 that is configured to engage with the distal end 103 of the arrow shaft 102 (FIGS. 1 and 2) to position the point coupling portion 114 relative to the arrow shaft 102.

In some embodiments, a portion of the insert 108 (e.g., the shaft coupling portion 112) may include a cavity 136 for receiving one or more weights in the cavity 136, which is positioned in the insert 108 and, ultimately, within the arrow shaft 102 and the arrow assembly 100 (FIGS. 1 and 2). Such weights in the cavity 136 of the insert 108 may enable a user (e.g., an archer) to tailor the amount of weight proximate a distal portion of the arrow assembly 100.

As above, the insert 108 includes the point coupling portion 114 (e.g., on side opposing the shaft coupling portion 112) that is configured to couple with the point 104 (FIGS. 1 and 2). For example, the point coupling portion 114 of the insert 108 may couple with the threaded portion 122 of the point 104 via threads 138 formed within the threaded aperture 119 of the point coupling portion 114 of the insert 108.

Figure 5:
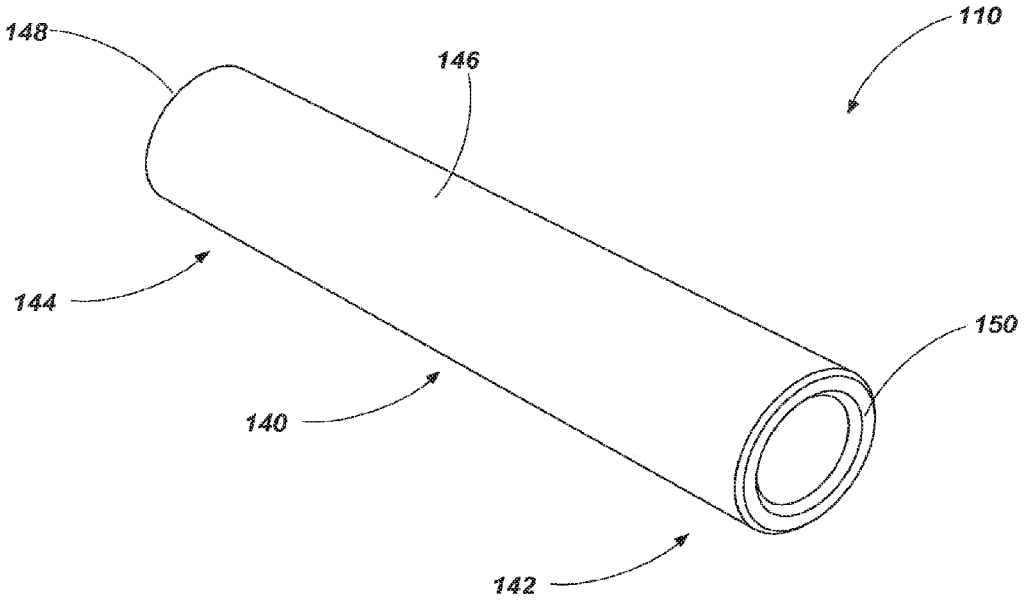
FIG. 5 is a perspective view of another portion of an adapter assembly that may be utilized with the other portion of the adapter assembly shown in FIGS. 3 and 4 and an arrow assembly (e.g., the arrow assembly shown in FIGS. 1 and 2) in accordance with an embodiment of the present disclosure.
Figure 6:
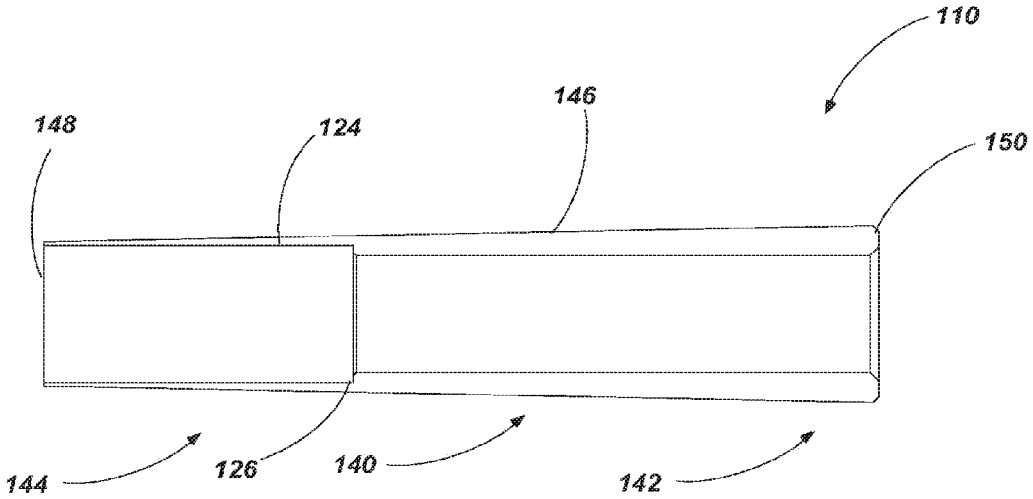
FIG. 6 is a longitudinal cross-sectional view of the portion of the adapter assembly of FIG. 5.

FIG. 5 is a perspective view of another portion (e.g., the outer sleeve 110) of an adapter assembly (e.g., the adapter assembly 106 shown and described with reference to FIGS. 1 and 2) that may be utilized with the insert 108 shown and described with reference to FIGS. 3 and 4 and an arrow assembly (e.g., the arrow assembly 100 shown in FIGS. 1 and 2). FIG. 6 is a longitudinal cross-sectional view of the outer sleeve 110 of FIG. 5. As shown in FIGS. 5 and 6, a first portion (e.g., a middle portion 140) of the outer sleeve 110 may be sized to extend around and abut the point coupling portion 114 of the insert 108 (FIGS. 1 and 2) and a second portion (e.g., distal portion 142) may be sized to receive (e.g., extend around and/or abut) the non-threaded portion 120 of the point 104 (FIGS. 1 and 2). As depicted, both the middle portion 140 and the distal portion 142 may exhibit substantially similar (e.g., the same) inner diameter.

A third portion (e.g., a proximal portion 144) of the outer sleeve 110 may be sized to be disposed over and extend around a portion of the arrow shaft 102 (FIGS. 1 and 2). For example, the outer sleeve 110 may include the stepped portion 124 having an inner diameter that is greater than the inner diameter of one or both of the middle portion 140 and the distal portion 142. The differing inner diameters may act to form the internal flange 126 within the outer sleeve 110 that may abut with the distal end 103 of the arrow shaft 102 (FIGS. 1 and 2).

In some embodiments, the outer sleeve 110 may exhibit an outer surface 146 that transitions between the outer diameter of the arrow shaft 102 (FIGS. 1 and 2) (e.g., a reduced diameter arrow shaft 102) and an outer diameter of the point 104 (FIGS. 1 and 2) where at least a portion of the outer diameter of the point 104 (e.g., the portion adjacent to the outer sleeve 110) may be larger than the outer diameter of the arrow shaft 102. For example, at least a portion of the outer surface 146 of the outer sleeve 110 may comprise a tapered surface (e.g., a gradual, constant taper) extending from a first, proximal end 148 having a reduced diameter to a second, distal end 150 having an enlarged diameter that is larger than the reduced diameter of the first, proximal end 148 of the outer sleeve 110.

Figure 7:
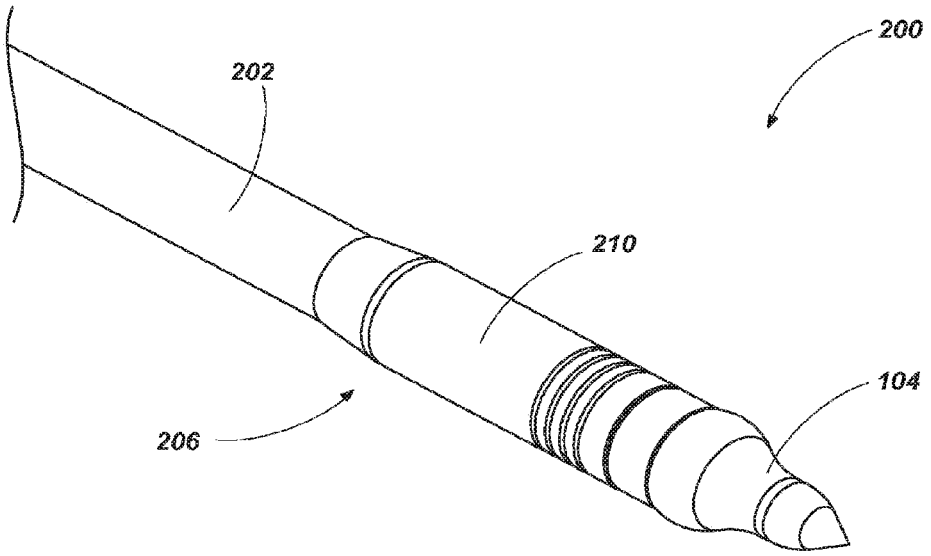
FIG. 7 is a perspective view of a portion of an arrow assembly including an adapter assembly in accordance with an embodiment of the present disclosure.

FIG. 7 is a perspective view of a portion of an arrow assembly. As shown in FIG. 7, the arrow assembly 200 includes an arrow shaft 202 coupled to a point 104 with an adapter assembly 206 comprising outer sleeve 210. Adapter assembly 206 may be similar to and include any of the same or similar components and configurations as the adaptor assembly 106 discussed above in relation to FIGS. 1 through 6.

Figure 8:
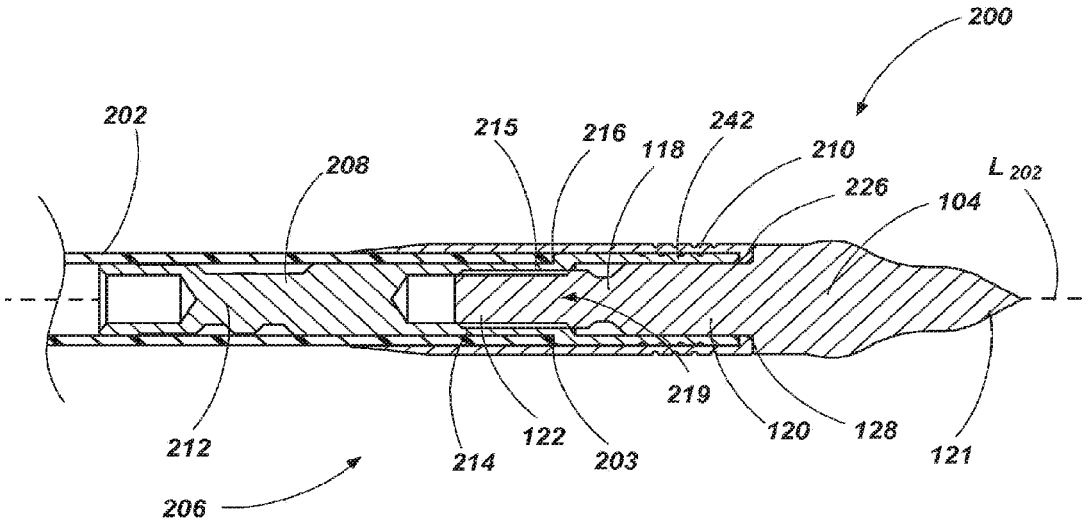
FIG. 8 is a longitudinal cross-sectional view of the portion of the arrow assembly including the adapter assembly of FIG. 7.

FIG. 8 is a longitudinal cross-sectional view of the portion of the arrow assembly 200 including the adapter assembly 208 of FIG. 7. As shown in FIG. 8, the adapter assembly 206 may include an insert 208 and an outer sleeve 210 disposed about at least a portion of the insert 208. For example, at least a portion of the outer sleeve 210 may extend along at least a portion of the insert 208 in a direction along a longitudinal axis $L_{202}$ of the arrow shaft 202. The outer sleeve 210 may be separate from the insert 208, for example, where each of the insert 208 and the outer sleeve 210 comprise individual components rather than one unitary body.

In some embodiments, one or more portions of the adapter assembly 206 may comprise materials such as a metal, a metal alloy, a composite, a polymer, a ceramic, or combinations thereof. For example, the insert 208 and the outer sleeve 210 may each comprise a metal alloy, such as, for example, high-strength aluminum.

As depicted, the insert 208 of the adapter assembly 206 may be received (e.g., partially received) in the hollow interior of the arrow shaft 202 (e.g., the insert 208 and the arrow shaft 202 are mutually arranged such that both the insert 208 and the arrow shaft 202 would be intersected by a plane extending in a direction transverse to the longitudinal axis $L_{202}$ of the arrow shaft 202). For example, a shaft coupling portion 212 of the insert 208 may be received within the arrow shaft 202 and may be coupled to the arrow shaft 202 (e.g., with an adhesive, with a mechanical interference coupling or fit, etc.).

The insert 208 may also include a point coupling portion 214 (e.g., on side opposing the shaft coupling portion 212) that couples with the point 104. For example, the point coupling portion 214 of the insert 208 may couple with the point 104 via threaded connection 215, which includes threads in the point coupling portion 214 and complementary threads on the point 104.

As depicted in FIG. 8, only a portion of the point coupling portion 214 (e.g., an enlarged diameter section 242) may extend from a distal end 203 of the arrow shaft 202. For example, the enlarged diameter section 242 may extend from the distal end 203 of the arrow shaft 202 and be outside or external to the arrow shaft 202 (e.g., not within the hollow bore of the arrow shaft 202). In such an embodiment, the positioning of the enlarged diameter section 242 of the insert 208 outside of the arrow shaft 202 may also position only a portion of the point 104 (e.g., the non-threaded portion 120 and distal portion 121 of the point 104) outside or external to the arrow shaft 202 (e.g., not within the hollow bore of the arrow shaft 202). Further, a remaining portion of the shank 118 (e.g., at least a majority of the threaded portion 122) may be positioned within the arrow shaft 202.

In some embodiments, the insert 208 may include a lip or flange 216 that engages with the distal end 203 of the arrow shaft 202 to position the enlarged diameter section 242 of the insert 208 relative to the arrow shaft 202. For example, the flange 216 may engage with the distal end 203 of the arrow shaft 202 to position the enlarged diameter section 242 of the insert 208 external to the hollow bore of the arrow shaft 202 and to further position the shaft coupling portion 212 and the remaining portion of the point coupling portion 214 (e.g., a threaded aperture 219 of the point coupling portion 214 of the insert 208) within the arrow shaft 202.

As further shown in FIG. 8, the outer sleeve 210 may be disposed over and extend around at least a portion of the insert 208 and a portion of the arrow shaft 202. The outer sleeve 210 may be disposed over and extend around at least the point coupling portion 214 of the insert 208. For example, the outer sleeve 210 may extend along (e.g., in the direction along the longitudinal axis $L_{202}$ of the arrow shaft 202) and around (e.g., about the longitudinal axis $L_{202}$ of the arrow shaft 202) an entirety of the point coupling portion 214 of the insert 208 (e.g., both the enlarged diameter section 242 of the insert 208 and the threaded aperture 219 of the point coupling portion 214 of the insert 208). The outer sleeve 210 may abut with the enlarged diameter section 242 of the insert 208 to be centered around (e.g., concentric with) the enlarged diameter section 242 and the point coupling portion 214 of the insert 208.

In some embodiments, the outer sleeve 210 may include an internal flange 226 within the outer sleeve 210 that engages with a distal end of the insert 208. In such an embodiment, the remainder of the outer sleeve 210 may have a constant inner diameter.

In some embodiments, the outer sleeve 210 may extend along the insert 208 a select distance in the direction along the longitudinal axis $L_{202}$ of the arrow shaft 202. For example, the outer sleeve 210 may extend along at least one quarter of the length (e.g., at least one third of the length of the insert 208, at least one half of the length of the insert 208) of the insert 208 in the direction along the longitudinal axis $L_{202}$ of the arrow shaft 202.

A third portion (e.g., a proximal portion) of the outer sleeve 210 may be disposed over and extend around a portion of the arrow shaft 202. In some embodiments, the inner diameter of the outer sleeve 210 may be sized to be in at least partial contact with the outer surface of the arrow shaft 202.

The outer sleeve 210 may extend along a portion of the arrow shaft 202 that has a portion of the insert 208 received in the arrow shaft 202. For example, a portion of the outer sleeve 210 may extend along both a portion of the arrow shaft 202 and at least a portion of the insert 208 that is received within that portion of the arrow shaft 202 in the direction along the longitudinal axis $L_{202}$ of the arrow shaft 202. In some embodiments, the outer sleeve 210 may extend a length of approximately 0.25 inch to 1.50 inch (6.35 mm to 38.1 mm) (e.g., 1 inch (25.4 mm)) along the arrow shaft 202 in the direction along the longitudinal axis $L_{202}$ of the arrow shaft 202.

In some embodiments, the coupling of the insert 208 within the arrow shaft 202 (e.g., via an adhesive) and the coupling of the point 104 to the point coupling portion 214 of the insert 208 may act to secure the outer sleeve 210 to the arrow shaft 202. For example, as the point 104 is threaded into point coupling portion 214 of the insert 208, a flange 228 on the point 104 may force the inner flange 226 of the outer sleeve 210 into contact with the distal end of the insert 208. Compression of the outer sleeve 210 (e.g., the inner flange 226) between the point 104 and the insert 208 may act to secure the outer sleeve 210 on the arrow shaft 202 and the arrow assembly 200.

Embodiments of the present disclosure may provide adaptor assemblies for use with arrow assemblies that may increase one or more of the strength, stability, and accuracy of the overall arrow assembly. For example, embodiments of adaptor assemblies as disclosed herein may be particularly useful with arrow assemblies having reduced diameter arrow shafts that are unable to accommodate at least a portion (e.g., a portion of the shank) of a point (e.g., a point that complies with the guidelines set by the ATA). As discussed above, while standard arrow assemblies may be able to utilize inserts that have a majority or an entirety of the insert in the arrow shaft to receive the majority or entirety of the shank of the point, reduced or small diameter arrow assemblies, as detailed above, have a reduced inner diameter that may be unable to accommodate the shank of the point. Accordingly, at least a portion of the insert and shank of the point must be positioned outside or external to the arrow shaft or an outsert (i.e., an adaptor coupled to the outer diameter of the arrow shaft) must be utilized. However, such configurations may decrease one or more of the strength, stability, and accuracy of the overall arrow assembly.

Embodiments of present disclosure provide adaptor assemblies and arrow assemblies that enable an insert having a portion located outside of the arrow shaft to accommodate the shank of the point while the outer sleeve extending around at least a portion of the insert strengthens the connection between the insert and the arrow shaft, strengthening the connection between the point and the arrow shaft provided by the adaptor assembly. As detailed above, the combination of the insert and outer sleeve of embodiments of the adaptor assemblies disclosed herein enables the insert to engage with an inner surface of the arrow shaft while the outer sleeve is also disposed around (e.g., engaged with) an outer surface of the arrow shaft. Further, both the insert and the outer sleeve of the adaptor assembly may abut with and be centered or aligned off of (e.g., relative to) the inner diameter or surface of the arrow shaft. That is, the insert engages the inner diameter of the arrow shaft and the outer sleeve, in turn, engages with a portion of the outer surface of the insert. Such a configuration enables the entire adaptor assembly (e.g., both the insert and outer sleeve) to base its concentricity off the inner diameter of the arrow shaft rather than an outer diameter or surface of the arrow shaft (e.g., as is the case with an outsert).

While particular embodiments of the disclosure have been shown and described, numerous variations and alternate embodiments encompassed by the present disclosure will occur to those skilled in the art. Accordingly, the disclosure is only limited in scope by the appended claims and their legal equivalents.

What is claimed is:

1. An adapter assembly for an arrow assembly having an arrow shaft and a point, the adapter assembly comprising:

an insert configured to be coupled to the arrow shaft and configured to be coupled to the point; and an outer sleeve disposed around at least a section of the insert, the outer sleeve including a proximal end near the arrow shaft and a distal end near the point, the outer sleeve being tapered such that an outer diameter of the proximal end is less than an outer diameter of the distal end, wherein the insert may extend out of a distal end of the arrow shaft so that the point is substantially external to the arrow shaft.

2. The adapter assembly of claim 1, wherein the insert includes a reduced diameter section with one or more protrusions extending out from the reduced diameter section and configured to engage with an inner surface of the arrow shaft.

3. The adapter assembly of claim 1, wherein the insert includes a portion configured to be received within the arrow shaft, the portion having a cavity therein configured to receive one or more weights.

4. The adapter assembly of claim 1, wherein the insert is coupled to the arrow shaft using adhesive or mechanical interference.

5. The adapter assembly claim 1, wherein the insert includes a threaded aperture configured to be coupled to a threaded shank on the point.

6. The adapter assembly of claim 1, wherein the insert includes a flange configured to abut a distal end of the arrow shaft.

7. An adapter assembly for an arrow assembly having an arrow shaft and a point, the adapter assembly comprising:

an insert configured to be coupled to the arrow shaft and configured to be coupled to the point; and an outer sleeve disposed around at least a section of the insert, the outer sleeve having a uniform inner diameter configured to be in contact with an outer surface of the arrow shaft, wherein the insert is configured to allow at least a portion of the point to be internal to the arrow shaft.

8. The adapter assembly of claim 7, wherein the outer sleeve includes a flange having a first side and a second side, wherein the first side abuts a distal end of the insert, and the second side abuts a flange on the point.

9. The adapter assembly of claim 7, wherein the insert includes a threaded aperture configured to be coupled to a threaded shank on the point.

10. An adapter assembly for an arrow assembly having an arrow shaft and a point, the adapter assembly comprising:

an insert comprising:

a shaft coupling portion configured to be received within the arrow shaft;

a point coupling portion configured to be coupled to the point, the point coupling portion being external to the arrow shaft; and a middle portion connecting the shaft coupling portion and the point coupling portion; and an outer sleeve disposed around at least a portion of the insert.

11. An arrow assembly comprising:

an arrow shaft with a distal end;

a point having a distal end and a proximal end comprising:

a shank extending out from the proximal end of the point, the shank including a non-threaded portion and a threaded portion, and a flange between the shank and the distal end of the point; and an adapter assembly comprising:

an insert comprised of:

a middle portion;

a shaft coupling portion proximal to the middle portion, the shaft coupling portion comprised of:

a reduced diameter section having one or more protrusions extending radially out from the reduced diameter section to a radius equal to that of the middle portion of the insert, the protrusions configured to engage with an inner surface of the arrow shaft; and a cavity configured to receive one or more weights;

a point coupling portion distal to the middle portion, the point coupling portion including a threaded aperture configured to be coupled with the threaded portion of the shank of the point; and a flange configured to abut the distal end of the arrow shaft; and an outer sleeve having:

a tapered outer surface such that the outer sleeve has a smaller diameter at a proximal end of the outer surface than at a distal end of the outer sleeve; and a flange abutting the flange of the point, wherein the outer sleeve is disposed around at least a portion of the insert.

12. The arrow assembly of claim 11, wherein the threaded aperture of the point coupling portion of the insert extends out of the distal end of the arrow shaft so that no part of the point is within the arrow shaft when the insert is coupled within the arrow shaft and when the point is coupled to the point coupling portion.

13. The arrow assembly of claim 12, wherein the outer sleeve has a stepped portion abutting the distal end of the shaft.

14. The arrow assembly of claim 11, wherein the point coupling portion of the insert includes an enlarged diameter section extending from the flange of the insert to the flange of the outer sleeve allowing a majority of the threaded portion of the shank to be within the arrow shaft.

15. An adapter assembly for an arrow assembly having an arrow shaft and a point, the adapter assembly comprising:

an insert configured to be coupled to the arrow shaft and configured to be coupled to the point; and an outer sleeve disposed around at least a section of the insert, the outer sleeve including a stepped portion that abuts a distal end of the arrow shaft, wherein the insert may extend out of a distal end of the arrow shaft so that the point is substantially external to the arrow shaft.

16. The adapter assembly of claim 15, wherein the stepped portion of the outer sleeve has a larger inner diameter than an inner diameter of a remainder of the outer sleeve.

* * * * *